US009615648B1

(12) United States Patent
Chang

(10) Patent No.: US 9,615,648 B1
(45) Date of Patent: Apr. 11, 2017

(54) BACKPACK

(71) Applicant: Teng-Yao Chang, Taichung (TW)

(72) Inventor: Teng-Yao Chang, Taichung (TW)

( * ) Notice: Subject to any disclaimer, the term of this patent is extended or adjusted under 35 U.S.C. 154(b) by 0 days.

(21) Appl. No.: 15/077,247

(22) Filed: Mar. 22, 2016

(51) Int. Cl.
*A45F 3/04* (2006.01)
*A45C 13/10* (2006.01)

(52) U.S. Cl.
CPC ..... *A45F 3/04* (2013.01); *A45C 13/103* (2013.01)

(58) Field of Classification Search
CPC ... A45F 3/04; A45F 3/042; A45F 3/06; A45C 13/103
USPC ..... 224/627, 657
See application file for complete search history.

(56) References Cited

U.S. PATENT DOCUMENTS 7,422,131 B2 * 9/2008 Cohen ..... A45F 3/04 224/651
8,152,374 B2 * 4/2012 Shaul ..... A45C 13/002 150/105
9,090,394 B2 * 7/2015 Peisley ..... A45F 3/04
2004/0188482 A1 * 9/2004 Wilson ..... A45C 3/10 224/576
2006/0261115 A1 * 11/2006 Gracer ..... A45F 3/04 224/653
2011/0240692 A1 * 10/2011 Park ..... A45C 5/02 224/155
2013/0026204 A1 * 1/2013 Abramowitz ..... A45C 13/03 224/613
2013/0146627 A1 * 6/2013 Kryklywicz ..... A45C 13/103 224/235
2014/0353351 A1 * 12/2014 Armstrong ..... B65D 85/00 224/600
2016/0157588 A1 * 6/2016 Ford ..... A45F 3/04 224/657
2016/0221725 A1 * 8/2016 Chang ..... A45C 13/103

* cited by examiner

*Primary Examiner* — Justin Larson
(74) *Attorney, Agent, or Firm* — Ming Chow; Sinorica, LLC

(57) ABSTRACT

A backpack is provided, which includes a bag, a first to third zippers, a first extended fabric, and a buckle set. The bag includes a first cloth, a second cloth, and a third cloth, which neighbor each other. Three openings are formed among the three cloths. The three zippers respectively seal the three openings. Two first fasteners are provided on the second and the third cloths, wherein a first segment of the third zipper is located between the two first fasteners. The buckle set includes two buckles, connected to the first cloth and the slider of the third zipper respectively. With the first extended fabric and the buckle set, the backpack is double anti-theft; on the other hand, after the two buckles are detached from each other, the bag is easy to be opened by pulling the first extended fabric.

13 Claims, 8 Drawing Sheets

BACKPACK

BACKGROUND OF THE INVENTION

1. Technical Field

The present invention relates generally to a backpack, and more particularly to a backpack which is anti-theft yet still easy to be opened.

2. Description of Related Art

Backpacks are commonly used in outdoor activities such as walking, hiking, excursion, traveling, and cycling. A backpack is usually worn on back through shoulder straps, and is adapted to carry several objects at once (even for large or heavy ones) without using hands; therefore, a backpack is useful in many situations, for it would be difficult to carry heavy things by hands for a long period. Moreover, with a backpack on back, hands of a user are free to do other things.

Although there are above advantages for using a backpack, it is not easy for users to aware of whether the zipper of the backpack on the back is opened by someone. Especially in the crowd, there might be a theft who is behind the user and trying to open the zipper without being noticed. A common way to avoid such problem is to carry the backpack in front so that the user can keep an eye on it and hold it by hands. However, in this case, the backpack would hinder the movements of the arms of the user; moreover, the center of gravity of the user would move forward, which burdens the user's low back.

BRIEF SUMMARY OF THE INVENTION

In view of the above, the primary objective of the present invention is to provide a backpack which is anti-theft yet still easy to be opened.

The present invention provides a backpack, including a bag, a first zipper, a second zipper, a third zipper, two first fasteners, a first extended fabric, and a buckle set, wherein the bag includes a first cloth, a second cloth, and a third cloth, which neighbor each other. A second opening is formed between the first cloth and the third cloth; a third opening is formed between the second cloth and the third cloth. The first zipper and the second zipper are provided on the bag to seal the first opening and the second opening respectively, wherein an end of the first zipper neighbors an end of the second zipper. The third zipper is provided on the bag to seal the third opening. The third zipper includes a first segment, a second segment, and a slider adapted to slide along the first segment and the second segment, wherein the first segment neighbors both the end of the first zipper and the end of the second zipper. The two first fasteners are provided on the second cloth and the third cloth respectively, wherein the first segment of the third zipper is located between the two first fasteners. The first extended fabric is connected to the first cloth, wherein a second fastener is provided on the first extended fabric to be detachably fastened to the two first fasteners. The first extended fabric is adapted to cover the first segment and the slider of the third zipper. The buckle set includes two buckles which are adapted to be detachably buckled together, wherein one of the two buckles is connected to the first cloth, and the other of the two buckles is connected to the slider of the third zipper.

Whereby, with the first extended fabric and the buckle set, the backpack is double anti-theft; on the other hand, after the two buckles are detached from each other, the bag is easy to be opened by pulling the first extended fabric.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
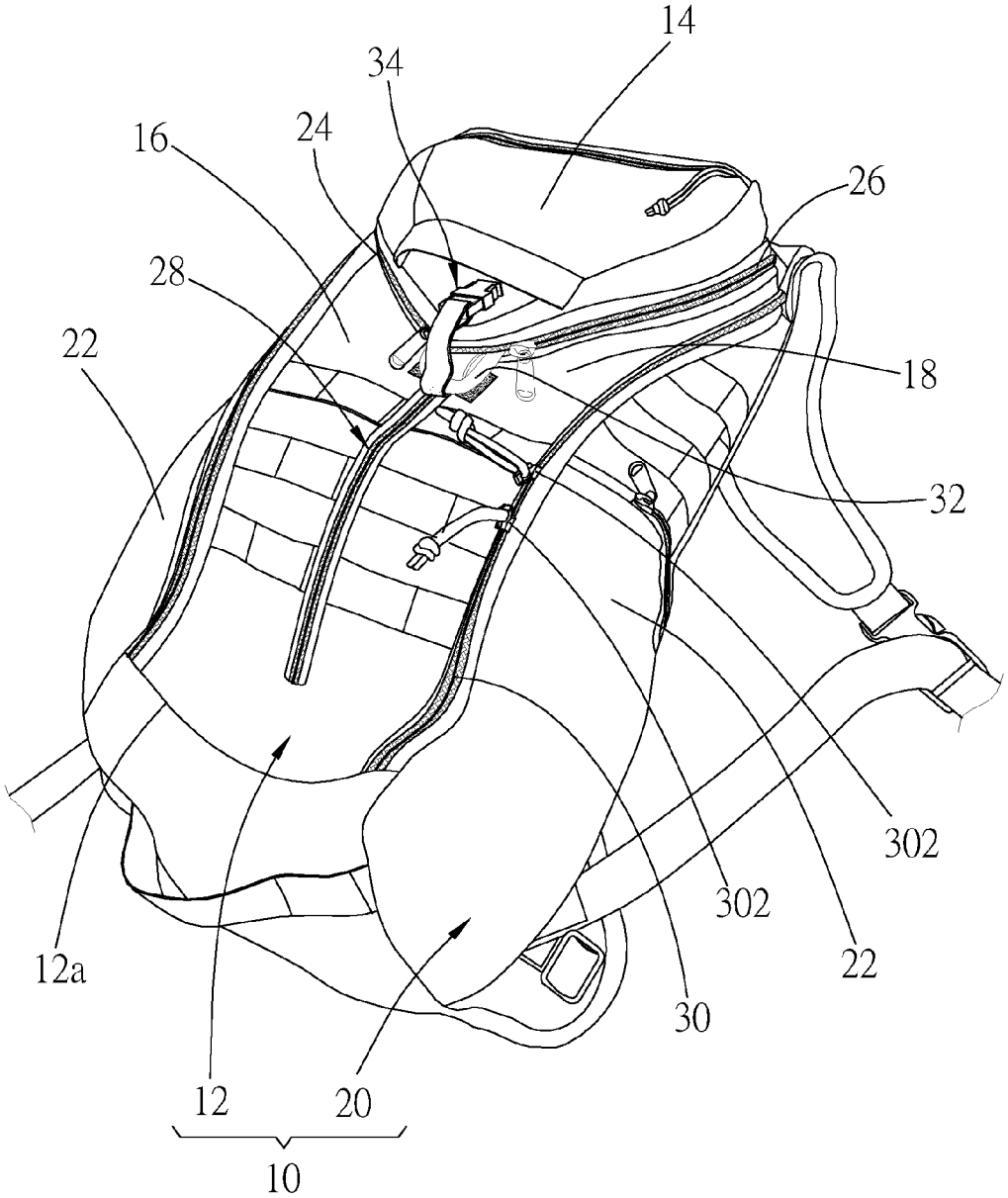
FIG. 1 is a perspective view of a preferred embodiment of the present invention.

As shown in FIG. 1, a backpack includes a bag 10, a first zipper 24, a second zipper 26, a third zipper 28, a fourth zipper 30, a first extended fabric 32, and a buckle set 34.

The bag 10 includes a covering portion 12 and a containing portion 20, wherein the covering portion 12 includes a first cloth 14, a second cloth 16, and a third cloth 18, which neighbor each other. The first cloth 14 has a shape of inverted triangle substantially, and is close to the top of the bag 10. The second cloth 16 and the third cloth 18 are provided beneath the first cloth 14, and are bilaterally symmetric. A first opening is formed between the left edge of the first cloth 14 and an edge of the second cloth 16, and a second opening is formed between the right edge of the first cloth 14 and an edge of the third cloth 18; both the first opening and the second opening communicate with the interior of the bag 10. A third opening is formed between another edge of the second cloth 16 and another edge of the third cloth 18, and also communicates with the interior of the bag 10. The covering portion 12 has a connecting end 12*a* beneath the second cloth 16 and the third cloth 18 to be connected to the containing portion 20. A fourth opening is formed between the covering portion 12 and the containing portion 20, and surrounds the first cloth 14, the second cloth 16, and the third cloth 18; also, the and fourth opening communicates with the interior of the bag 10. The containing portion 20 includes two side pockets 22 provided on two sides of the covering portion 12.

Figure 3:
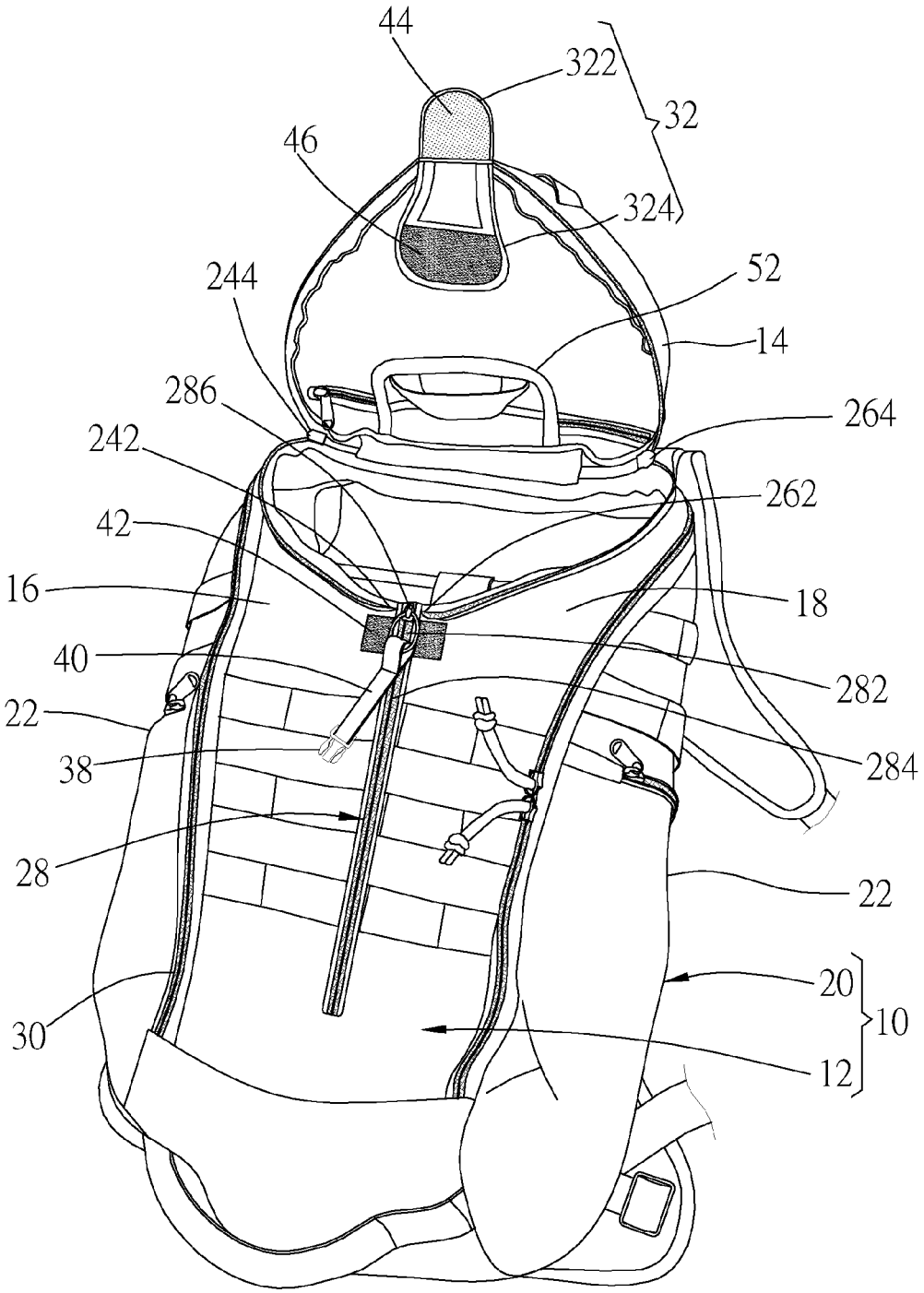
FIG. 3 is a perspective view of the backpack in FIG. 1, showing first cloth is lifted.

As illustrated in FIG. 3, the first zipper 24 and the second zipper 26 are provided on the bag 10, and respectively surround the first opening and the second opening to seal the first opening and the second opening. The first zipper 24 and the second zipper 26 are respectively provided on the left edge and the right edge of the first cloth 14, and an end 242 of the first zipper 24 neighbors an end 262 of the second zipper 26. The first zipper 24 and the second zipper 26 include a slider 244 and a slider 264 respectively.

The third zipper 28 is provided on the bag 10, and surrounds the third opening. The third zipper 28 includes a first segment 282, a second segment 284, and a slider 286, wherein the first segment 282 is located between the second segment 284 and the first cloth 14. Additionally, the first segment 282 neighbors the end 242 of the first zipper 24 and the end 262 of the second zipper 26. The slider 286 is movable along the first segment 282 and the second segment 284 to open or seal the third opening. Whereby, the first, the second, and the third zippers 24, 26, 28 are formed in a Y-shaped zipper set.

Figure 6:
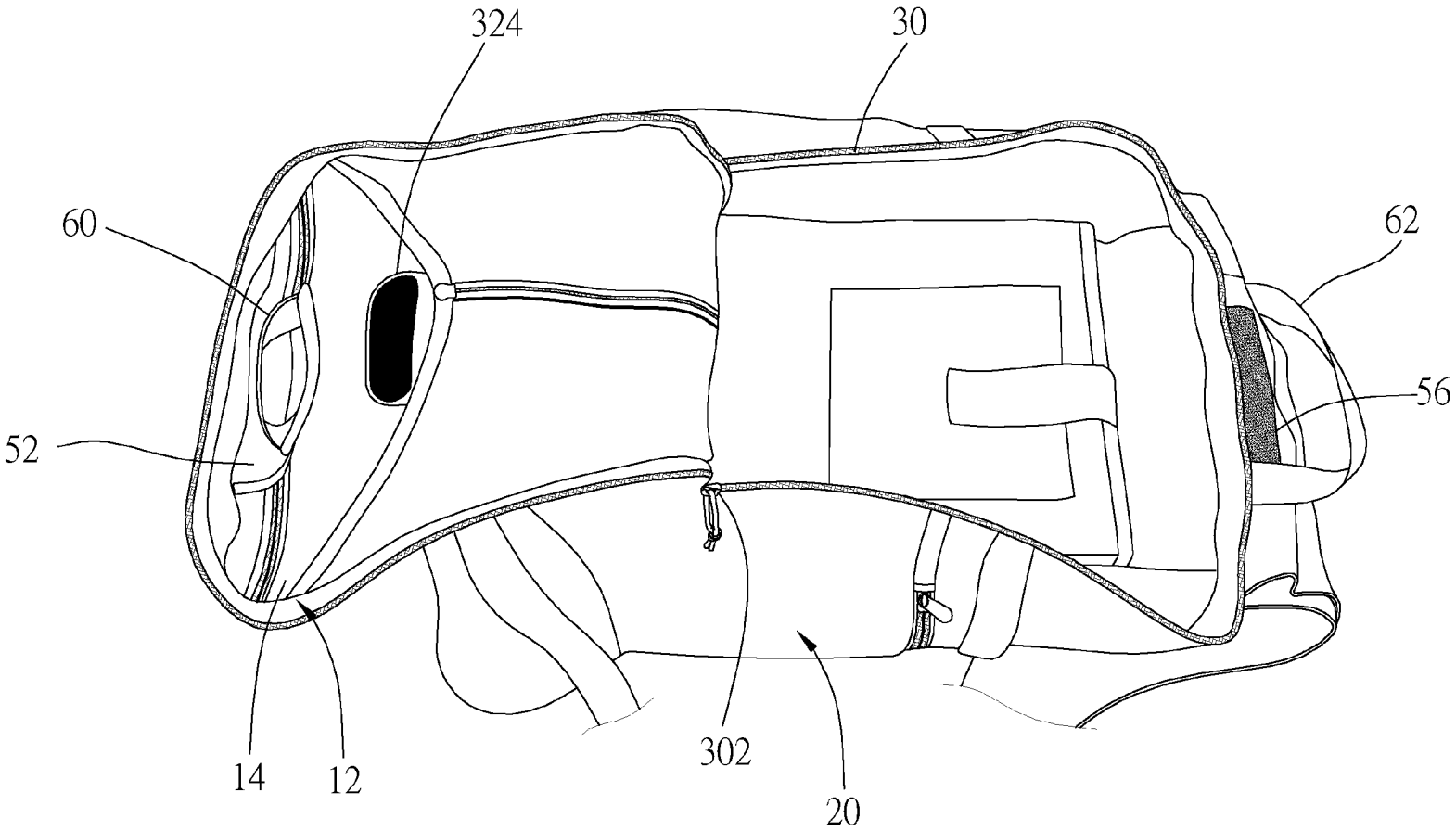
FIG. 6 is a perspective view of the backpack in FIG. 1, showing covering portion is lifted.

The fourth zipper 30 is provided on the bag 10, and surrounds the fourth opening to seal the fourth opening, wherein the fourth zipper 30 includes two sliders 302 to slide along and open the fourth opening in two different directions respectively. In additional, two ends of the fourth zipper 30 are respectively located at two sides of the connecting end 12*a*. A user can open the bag 10 by lifting the covering portion 12, as shown in FIG. 6, to put objects into the bag 10.

As depicted in FIG. 3, two first fasteners 42 are provided on the second cloth 16 and the third cloth 18 respectively, and neighbor the end 242 of the first zipper 24 and the end 262 of the second zipper 26. The first segment 282 of the third zipper 28 is located between the two first fasteners 42.

Figure 2:
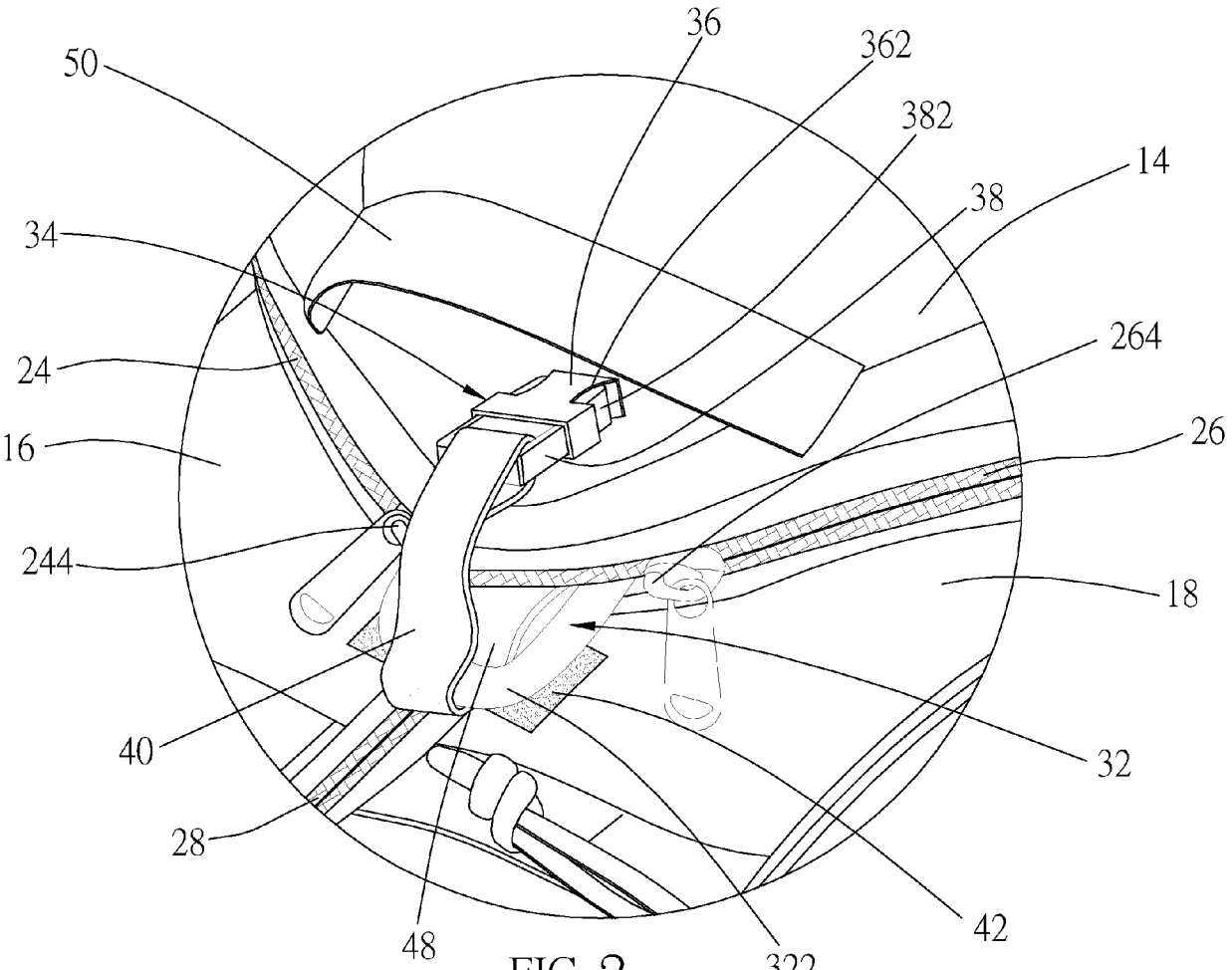
FIG. 2 is a partial enlarged view of the backpack in FIG. 1.

The first extended fabric 32 is connected to the first cloth 14, wherein in the preferred embodiment, the first extended fabric 32 includes a tongue 322 and a base 324. A second fastener 44 is provided on the inner side of the tongue 322; the base 324 is connected to the inner side of the first cloth 14, practically, the base 324 could be connected to the outer side of the first cloth 14. The first extended fabric 32 is adapted to be unfolded and folded; when the first extended fabric 32 is unfolded as shown in FIG. 1 and FIG. 2, the tongue 322 extends outside the bag 10 through a space between the slider 244 of the first zipper 24 and the slider 264 of the second zipper 26. In additional, the second fastener 44 could be detachably fastened to the two first fasteners 42. Whereby, the tongue 322 of the first extended fabric 32 covers the first segment 282 of the third zipper 28 and the slider 286 of the third zipper 28 to achieve the function of anti-theft of the backpack.

Figure 4:
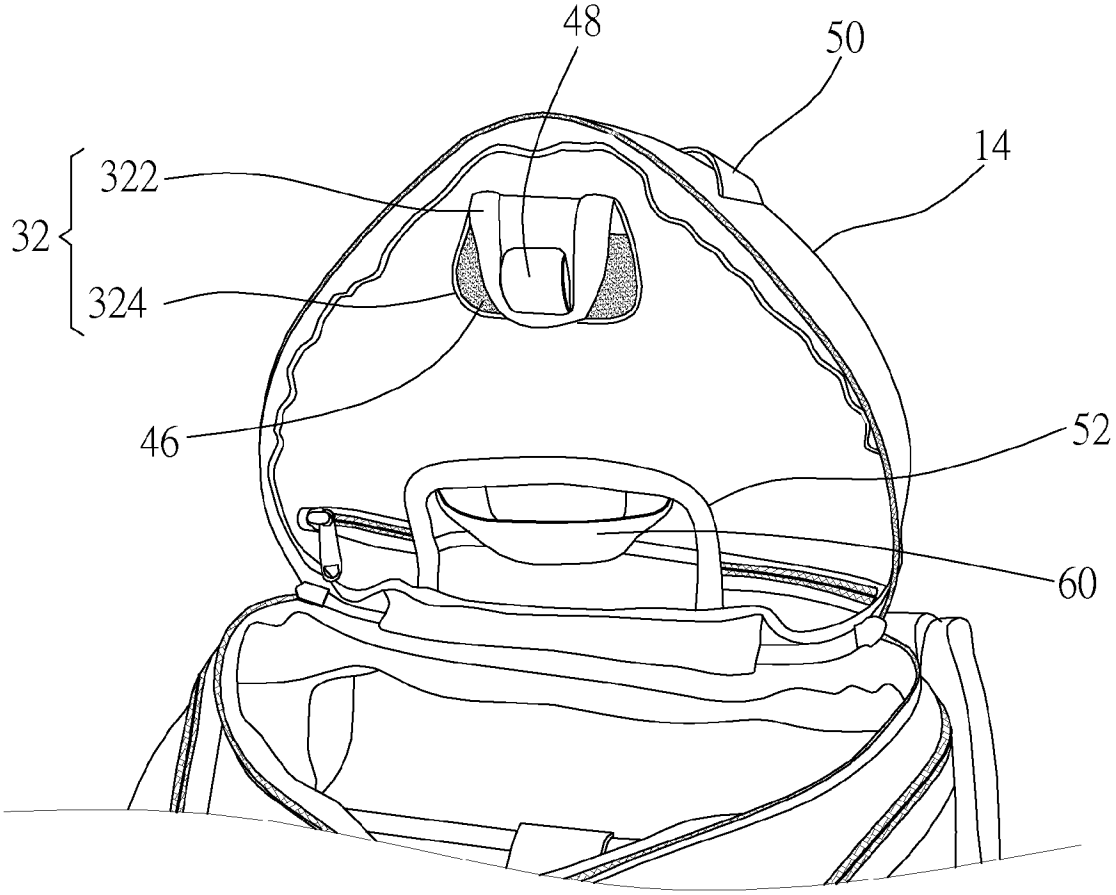
FIG. 4 is a perspective view of the backpack in FIG. 1, showing first extended fabric is folded.
Figure 5:
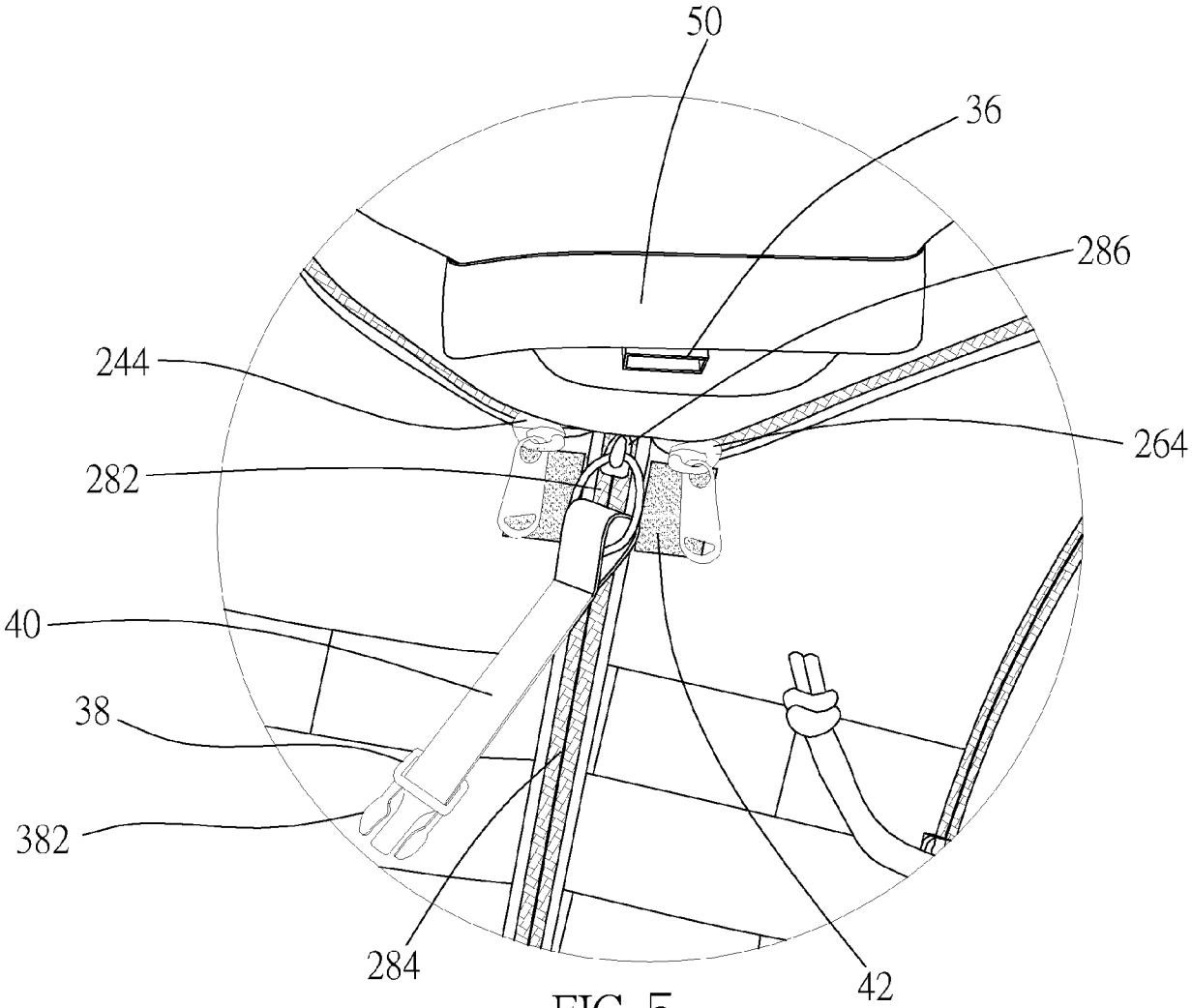
FIG. 5 is a perspective view of the backpack in FIG. 1, showing first extended fabric is received in the bag.

As illustrated in FIG. 3, for receiving the tongue 322 inside the bag 10, the backpack further includes a third fastener 46 provided on the inner side of the first cloth 14. In the preferred embodiment, the third fastener 46 in provided on the base 324 of the first extended fabric 32. As shown in FIG. 4 and FIG. 5, when the first extended fabric 32 is folded, the first extended fabric 32 is received in the bag 10, and the second fastener 44 on the tongue 322 is fastened to the third fastener 46. In this case, the slider 244 of the first zipper 24 and the slider 264 of the second zipper 26 could be moved to the ends 242 and 262 of the first zipper 24 and the second zipper 26 respectively.

A first pull strip 48 is provided on the outer surface of the tongue 322 of the first extended fabric 32, and two ends of the first pull strip 48 are connected to the tongue 322. The first pull strip 48 is adapted to be pulled to detach the second fastener 44 on the first extended fabric 32 and the two first fastener 42; such pulling force could also drive the two sliders 244, 264 move upwards to quickly lift the first cloth 14 as illustrated in FIG. 3.

As depicted in FIG. 2, a second pull strip 50 is provided on the first cloth 14, and two ends of the second pull strip 50 are connected to the outer surface of the first cloth 14. Similar to the first pull strip 48, the second pull strip 50 is adapted to be pulled to lift the first cloth 14 quickly especially when the first extended fabric 32 is folded position as shown in FIG. 5.

As illustrated in FIG. 2, the buckle set 34 includes two buckles adapted to be detachably connected, wherein the two buckles in the preferred embodiment are a female buckle 36 and a male buckle 38; the female buckle 36 is connected to the first cloth 14, and has two side holes 362 provided at two opposite sides thereof, which communicate with the interior of the female buckle 36. In additional, the two side holes 362 are covered by the second pull strip 50 as shown in FIG. 5. The male buckle 38 is connected to the slider 286 of the third zipper 28 through a linking strip 40. The male buckle 38 includes two arms 382 located in the two side holes 362, wherein the two side holes 362 and the arms 382 form a release portion of the buckle set 34, which is adapted to be pressed for detaching the two buckles 36, 38 from each other. When the male buckle 38 and the female buckle 36 are buckled together, the linking strip 40 covers the first extended fabric 32 and the first pull strip 48 to achieve a double anti-theft function.

Figure 7:
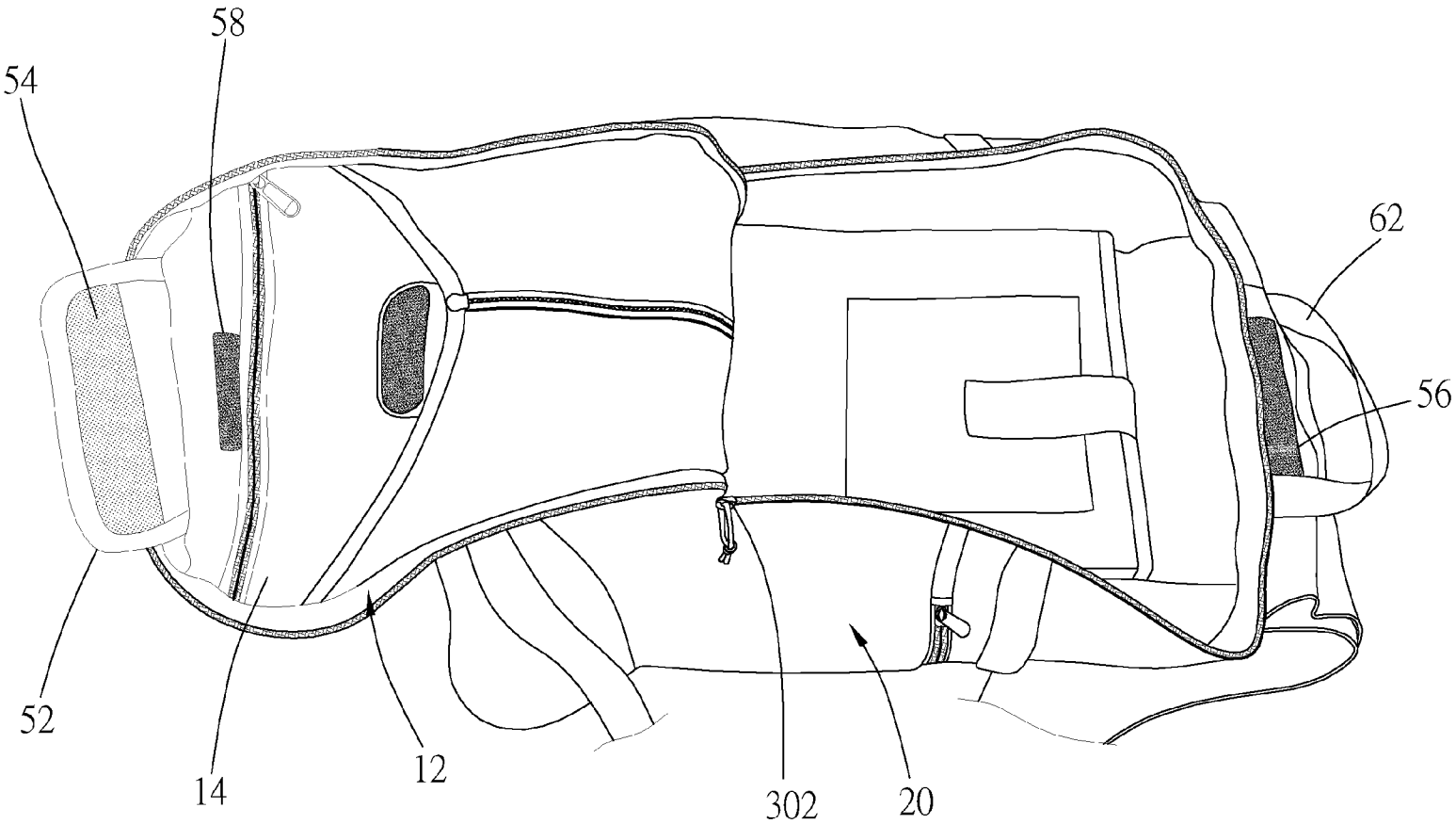
FIG. 7 is a perspective view of the backpack in FIG. 1, showing second extended fabric is lifted.

As illustrated in FIG. 6 to FIG. 7, for being convenient to be opened by lifting the covering portion 12, the backpack in the preferred embodiment further includes a second extended fabric 52, wherein an end of the second extended fabric 52 is connected to the inner side of the first cloth 14 where opposite to the connecting end 12*a*. Moreover, a fourth fastener 54 is provided on the second extended fabric 52. The second extended fabric 52 is adapted to be unfolded and folded, wherein when the second extended fabric 52 is unfolded, the second extended fabric 52 extends outside the bag 10 through a space between the two sliders 302 of the fourth zipper 30 as shown in FIG. 8; when the second extended fabric 52 is folded, the second extended fabric 52 abuts against the inner side of the first cloth 14 as shown in FIG. 6.

Figure 8:
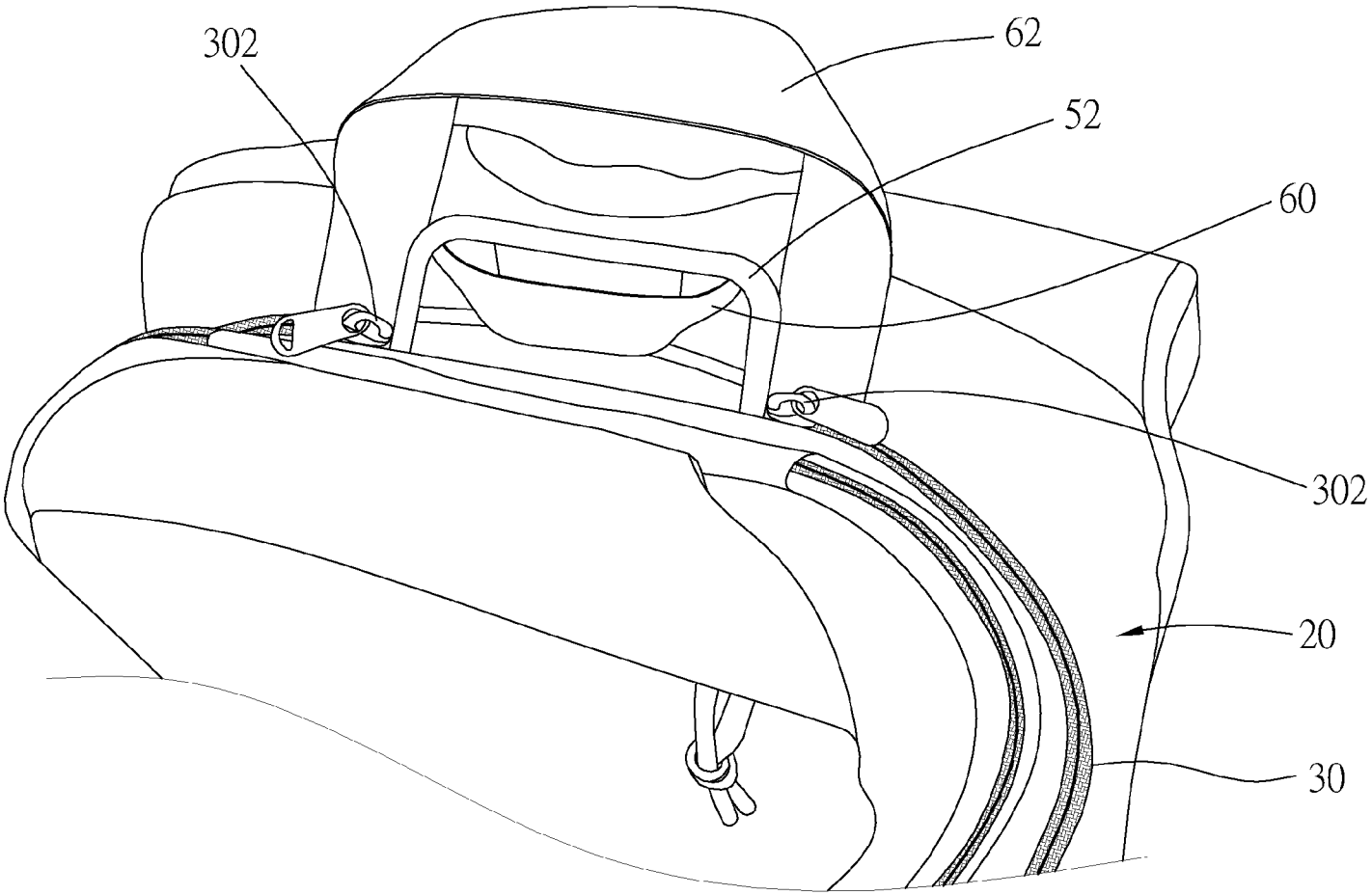
FIG. 8 is a perspective view of the backpack in FIG. 1, showing second extended fabric is extended outside the bag.

As depicted in FIG. 7 and FIG. 8, a fifth fastener 56 is provided at the top of the containing portion 20 to be fastened to the fourth fastener 54 when the second extended fabric 52 is unfolded. In additional, a sixth fastener 58 is provided on the inner side of the first cloth 14 to be connected to the fourth fastener 54 when the second extended fabric 52 is folded.

The covering portion 12 could be quickly lifted by pulling the top of the containing portion 20 and the second extended fabric 52 in two opposite directions, which drive the two sliders 302 move downwards. Additionally, a third pull strip 60 and a fourth pull strip 62 are respectively provided on the second extended fabric 52 and the top of the containing portion 20 to be held by the user.

In conclusion, with the first extended fabric 32 and the buckle set 34, the backpack is double anti-theft. On the other hand, after the two buckles 36, 38 are detached from each other, the bag 10 is easy to be opened by pulling the first extended fabric 32. Furthermore, the user can choose whether the foldable first extended fabric 32 covers the first segment of the third zipper 28. Additionally, with the foldable second extended fabric 52, the user can choose to open the fourth opening directly through the sliders 302 of the fourth zipper 30, or to quickly lift the covering portion 12 through the second extended fabric 52.

It must be pointed out that the embodiments described above are only some preferred embodiments of the present invention. All equivalent structures which employ the concepts disclosed in this specification and the appended claims should fall within the scope of the present invention.

What is claimed is:

1. A backpack, comprising:

a bag, comprising a first cloth, a second cloth, and a third cloth, which neighbor each other, wherein a first opening is formed between the first cloth and the second cloth; a second opening is formed between the first cloth and the third cloth; a third opening is formed between the second cloth and the third cloth;

a first zipper and a second zipper, which are provided on the bag to seal the first opening and the second opening respectively, wherein an end of the first zipper neighbors an end of the second zipper;

a third zipper, which is provided on the bag to seal the third opening, and comprises a first segment, a second segment, and a slider adapted to slide along the first segment and the second segment, wherein the first segment neighbors both the end of the first zipper and the end of the second zipper;

two first fasteners provided on the second cloth and the third cloth respectively, wherein the first segment of the third zipper is located between the two first fasteners;

a first extended fabric connected to the first cloth, wherein a second fastener is provided on the first extended fabric to be detachably fastened to the two first fasteners;

the first extended fabric is adapted to cover the first segment and the slider of the third zipper; and a buckle set comprising two buckles which are adapted to be detachably buckled together, wherein one of the two buckles is connected to the first cloth, and the other of the two buckles is connected to the slider of the third zipper.

2. The backpack of claim 1, further comprising a third fastener provided on an inner side of the first cloth; the first extended fabric is connected to the inner side of the first cloth, and is adapted to be unfolded and folded; when the first extended fabric is unfolded, the first extended fabric covers the first segment of the third zipper, and the second fastener is fastened to the two first fasteners; when the first extended fabric is folded, the first extended fabric is received in the bag, and the second fastener is fastened to the third fastener.

3. The backpack of claim 1, further comprising a first pull strip connected to the first extended fabric.

4. The backpack of claim 1, further comprising a second pull strip connected to the first cloth with two ends thereof; the buckle set has a release portion to be pressed for detaching the two buckles from each other, wherein the release portion is covered by the second pull strip.

5. The backpack of claim 4, wherein the two buckles comprise a female buckle and a male buckle, which are respectively connected to the first cloth and the slider of the third zipper; the female buckle has two side holes provided at two opposite sides thereof, and the side holes communicate with an interior of the female buckle; the male buckle comprises two arms to be located in the two side holes, wherein the two side holes and the two arms form the release portion; the second pull strip covers the two side holes.

6. The backpack of claim 5, wherein the buckle set comprises a linking strip connecting the male buckle and the slider of the third zipper; the linking strip covers the first extended fabric.

7. The backpack of claim 1, wherein the bag comprises a covering portion and a containing portion, and a fourth opening is formed between the covering portion and the containing portion; the covering portion comprises the first cloth, the second cloth, and the third cloth, and the fourth opening surrounds the first cloth, the second cloth, and the third cloth; a fourth zipper is provided on the bag to seal the fourth opening.

8. The backpack of claim 7, wherein the covering portion has a connecting end connected to the containing portion; the fourth zipper comprises two sliders adapted to slide along and open the fourth opening in two different directions respectively; two ends of the fourth zipper are respectively located at two sides of the connecting end.

9. The backpack of claim 8, further comprising a second extended fabric connected to an inner side of the covering portion with an end thereof, and another end of the second extended fabric is adapted to extend outside the bag through a space between the two sliders of the fourth zipper; a fourth fastener is provided on the second extended fabric, and a fifth fastener is provided on the containing portion to be fastened to the fourth fastener.

10. The backpack of claim 9, wherein the second extended fabric is adapted to be unfolded and folded; when the second extended fabric is unfolded, the second extended fabric extends outside the bag through the space between the two sliders of the fourth zipper; when the second extended fabric is folded, the second extended fabric abuts against an inner side of the first cloth.

11. The backpack of claim 10, further comprising a sixth fastener connected to the inner side of the first cloth; when the second extended fabric is folded, the fourth fastener is fastened to the sixth fastener.

12. The backpack of claim 9, further comprising a third pull strip and a fourth pull strip, wherein the third pull strip is connected to the second extended fabric, and the fourth pull strip is connected to a top of the bag.

13. The backpack of claim 8, wherein the bag comprises two side pockets provided on the containing portion and on two sides of the covering portion.

* * * * *